United States Patent [19]

Rudnick

[11] Patent Number: 4,587,007

[45] Date of Patent: May 6, 1986

[54] PROCESS FOR VISBREAKING RESIDS IN THE PRESENCE OF HYDROGEN-DONOR MATERIALS AND ORGANIC SULFUR COMPOUNDS

[75] Inventor: Leslie R. Rudnick, Lawrenceville, N.J.

[73] Assignee: Mobil Oil Corporation, New York, N.Y.

[21] Appl. No.: 764,522

[22] Filed: Aug. 12, 1985

Related U.S. Application Data

[63] Continuation of Ser. No. 648,413, Sep. 10, 1984, abandoned.

[51] Int. Cl.[4] ..... C10G 9/00

[52] U.S. Cl. ..... 208/107; 208/125

[58] Field of Search ..... 208/107, 56, 125, 106

[56] References Cited

U.S. PATENT DOCUMENTS

| | | | |
|---|---|---|---|
| 2,953,513 | 9/1960 | Langer, Jr. | 208/68 |
| 4,097,541 | 6/1978 | Sakai et al. | 208/107 |
| 4,235,699 | 11/1980 | Ratcliffe et al. | 208/107 |
| 4,293,404 | 10/1981 | Farcasiu et al. | 208/56 |
| 4,294,686 | 10/1981 | Fisher et al. | 208/56 |
| 4,357,228 | 11/1982 | Che | 208/8 R |
| 4,389,302 | 6/1983 | Garwin et al. | 208/106 |
| 4,389,303 | 6/1983 | Simo et al. | 208/107 |
| 4,401,561 | 8/1983 | Thompson et al. | 208/212 |
| 4,414,102 | 11/1983 | Rankel et al. | 208/211 |
| 4,465,584 | 8/1984 | Effron et al. | 208/107 |

FOREIGN PATENT DOCUMENTS

| | | | |
|---|---|---|---|
| 1476426 | 7/1973 | European Pat. Off. | 208/144 |

*Primary Examiner*—John Doll
*Assistant Examiner*—Anthony McFarlane
*Attorney, Agent, or Firm*—Alexander J. McKillop; Michael G. Gilman; Malcolm D. Keen

[57] ABSTRACT

A visbreaking process for the conversion of heavy residual petroleum charge stocks is provided in which an organic sulfur compound containing a thiol sulfur is added to said petroleum charge stock and the visbreaking reaction is carried out at increased severities in the presence of highly aromatic petroleum refinery hydrogen-donor materials which are characterized by an $H_{Ar}$ proton content between about 20 and 50 percent and an $H_{\alpha}$ proton content of at least about 20 percent. Typcial hydrogen-donor materials include FCC main column bottoms, clarified slurry oil and light cycle oil.

28 Claims, 1 Drawing Figure

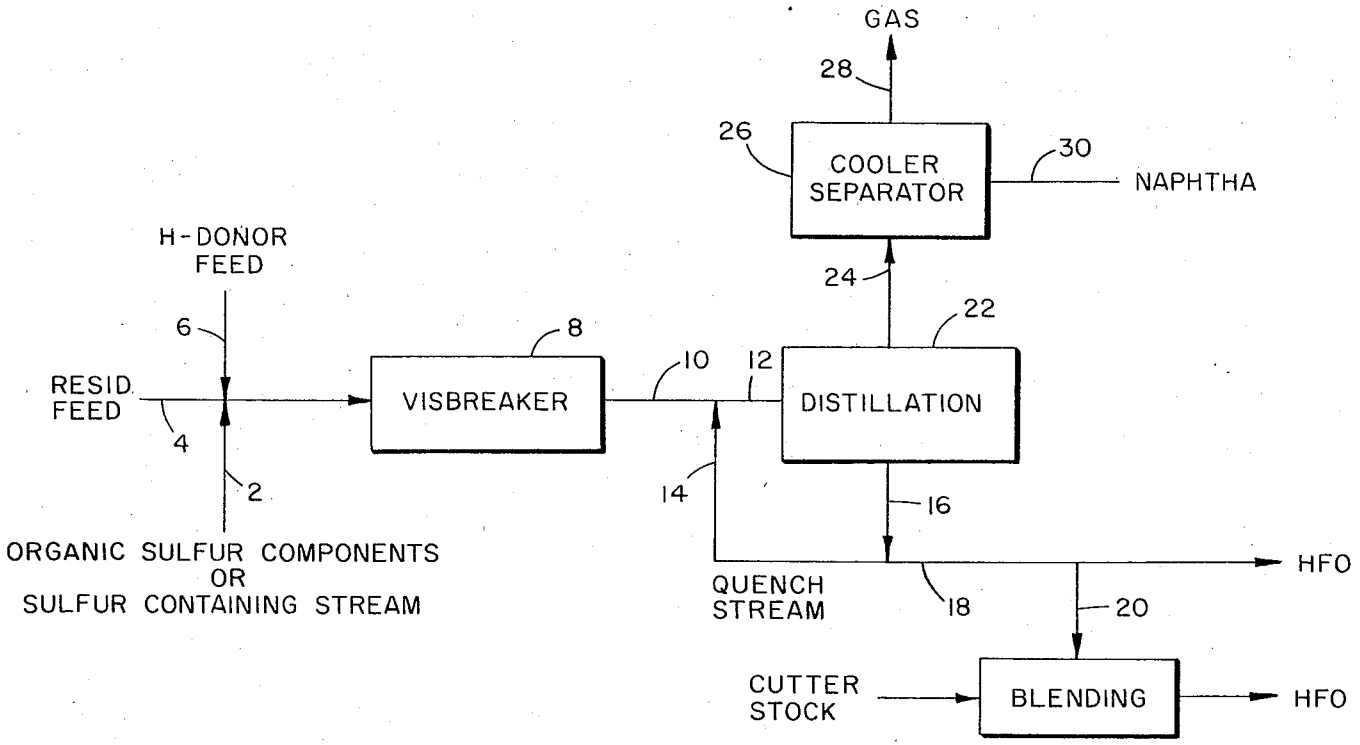
H-DONOR FEED
RESID FEED
ORGANIC SULFUR COMPONENTS OR SULFUR CONTAINING STREAM
VISBREAKER
DISTILLATION
COOLER SEPARATOR
GAS
NAPHTHA
QUENCH STREAM
HFO
BLENDING
CUTTER STOCK
HFO
2
4
6
8
10
12
14
16
18
20
22
24
26
28
30

PROCESS FOR VISBREAKING RESIDS IN THE PRESENCE OF HYDROGEN-DONOR MATERIALS AND ORGANIC SULFUR COMPOUNDS

This is a continuation of copending application Ser. No. 648,413, filed on Sept. 10, 1984 now abandoned.

BACKGROUND OF THE INVENTION

1. Field of the Invention

This invention relates to the processing of residual petroleum charge stocks and in particular to the visbreaking of such charge stocks in the presence of certain highly aromatic petroleum refinery hydrogen-donor materials.

2. Description of the Prior Art

Visbreaking, or viscosity breaking, is a well-known petroleum refining process in which reduced crudes are pyrolyzed, or cracked, under comparatively mild conditions to provide products having lower viscosities and pour points thus reducing the amounts of less-viscous and more valuable blending oils required to make the residual stocks useful as fuel oils. The visbreaker feedstock usually consists of a mixture of two or more refinery streams derived from sources such as atmospheric residuum, vacuum residuum, furfural-extract, propane deasphalted tar and catalytic cracker bottoms. Most of these feedstock components, except the heavy aromatic oils, behave independently in the visbreaking operation. Consequently, the severity of operation for a mixed feed is limited greatly by the least desirable (highest coke forming) components. In a typical visbreaking process, the crude or resid feed is passed through a heater and heated to about 800° to about 975° F. and at about 50 to about 1000 psig. Light gas-oil may be recycled to lower the temperature of the effluent to within about 500° to about 700° F. Cracked products from the reaction chamber are introduced into a flash distillation unit with the vapor overhead being separated in a fractionating column into a light distillate overhead product, e.g., gasoline and light gas-oil bottoms, and the liquid bottoms being separated in a vacuum fractionating column into heavy gas-oil distillate and residual tar. Examples of such visbreaking methods are described in Beuther et al, "Thermal Visbreaking of Heavy Residues," *The Oil and Gas Journal,* 57:46, Nov. 9, 1959, pp. 151–157; Rhoe et al, "Visbreaking: A Flexible Process," *Hydrocarbon Processing,* January 1979, pp. 131–136; and U.S. Pat. 4,233,138, all of which are incorporated herein by reference.

Various visbreaking processes are known where residual oils are added to the visbreaking stage with or without added hydrogen or hydrogen-donors. U.S. Pat. No. 3,691,058 discloses production of single ring aromatic hydrocarbon (160°–430° F.) by hydrocracking a heavy hydrocarbon feed (1050° F.−) and recycling 90°–160° F. and 430° F.+ product fractions to extinction. This is integrated with visbreaking of residua in the presence of 1–28 wt. % free radical acceptor at 700°–900° F. in the presence or absence of hydrogen (to enhance residua depolymerization). U.S. Pat. No. 4,067,757 discloses a process comprising of passing a resid up a bed of inert solids (packed bed reactor) in the presence or absence of 50–10,000 SOFH hydrogen at 750°–1000° F. to enhance middle distillate (350°–650° C.) production.

U.S. Pat. No. 2,953,513, incorporated herein by reference, discloses production of hydrogen-donors by partial hydrogenation of certain distillate thermal and catalytic tars, boiling above 700° F., containing a minimum of 40 wt.% aromatics, to contain H/C ratios of 0.7–1.6. The resid feed is then mixed with 9–83 vol. % of hydrogen-donor and thermallycracked at 800°–900° F. to produce low boiling products. U.S. Pat. No. 4,090,947 describes a thermal cracking process (800°–1000°F.) for converting resids to lighter products in the presence of 10–500 vol. % hydrogen-donor. The hydrogen-donor is produced by hydrotreating premium coker gas oil (650°–900° F.) by itself or a blend with gas oil produced in the thermal cracker. U.S. Pat. No. 4,292,168 discloses upgrading heavy hydrocarbon oils without substantial formation of char by heating the oil with hydrogen and a hydrogen transfer solvent without a catalyst at temperatures of about 320°–500° C. (666°–1026° F.) and a pressure of 22–180 bars for a time of about 3–30 minutes. Examples of hydrogen-donor transfer solvents include pyrene, fluoranthene, anthracene, benzanthracene, etc. U.S. Pat. No. 4,292,686 discloses a process for contacting a resid with a hydrogen-donor at 350°–500° C. and a pressure of 2–7 MPa with liquidly hourly space velocities ranging from 0.5–10.

U.S. patent application Ser. No. 519,625 filed Aug. 1, 1983, by Choi, Gross and Malladi which is incorporated herein by reference is directed to an improved process for the production of fuel oil products in which the formation of coke or filtration sediment is suppressed by visbreaking heavy petroleum redidua under liquid phase, non-catalytic conditions in the presence of certain hydrogen-donor materials and in the absence of added free hydrogen. By means of the invention described in that application, heavy petroleum oil feed stocks containing deleterious contaminants such as sulfur and nitrogen compounds, asphaltenes, metals, and the like, can be visbroken at high severities to provide lower molecular weight fuel oil products of improved viscosity and pour point characteristics. The process of that invention further offers the potential of substantially eliminating and/or reducing the need for cutter stock to meet fuel oil product viscosity specifications.

SUMMARY OF THE INVENTION

Briefly stated this invention comprises an improvement in the visbreaking process described in the '625 application which comprises introducing an organic sulfur compound or a hydrocarbon stream (liquid or vaporous, containing an organic sulfur compound into the heavy petroleum residua before it is subjected to visbreaking in the presence of a hydrogen donor according to the process of U.S. application Ser. No. 519,625 (Aug. 1, 1983).

BRIEF DESCRIPTION OF THE DRAWING

The attached drawing depicts schematically a simplified diagram of the visbreaking process of this invention.

DETAILED DESCRIPTION OF THE INVENTION

The hydrogen-donor used in the invention, as in the '625 application, is a thermally stable, polycyclic aromatic and hydroaromatic distillate mixture which results from one or more petroleum refining operations. The hydrogen-donor preferably has an average boiling point in the range between about 450° F. and 950° F., and an A.P.I. gravity below 20°.

Illustrative of suitable hydrogen-donors are highly aromatic petroleum refinery streams such as fluidized catalytic cracker (FCC) "main column" bottoms, (FCC) "light cycle oil," or thermal or catalytic cracker (TCC) "syntower" bottoms which contain a substantial proportion of polycyclic aromatic hydrocarbon constituents such as naphthalene, dimethylnaphthalene, anthracene, phenanthrene, fluorene, chrysene, pyrene, perylene, diphenyl, benzothiophene, tetralin, dihydronaphthalene, and the like. Such refractory petroleum media are resistant to conversion to lower molecular products by conventional non-hydrogenative procedures. Typically, these petroleum refinery residua and recycle fractions are hydrocarbonaceous mixtures having an average carbon to hydrogen ratio above about 1:1, and an average boiling point above about 450° F.

An FCC main column bottoms refinery fraction is a highly preferred donor for the practice of the present invention process. A typical FCC main column bottoms (or FCC clarified slurry oil (CSO)) contains a mixture of chemical constituents as represented in the following mass spectrometric analysis:

| Compounds | Aromatics | Naphthenic Aromatics | Labile $H_2$ % |
|---|---|---|---|
| Alkyl-Benzene | 0.4 | | 0.00 |
| Naphthene-Benzenes | | 1.0 | 0.03 |
| Dinapthene-Benzenes | | 3.7 | 0.16 |
| Naphthalenes | 0.1 | | 0.00 |
| Acenaphthenes, (biphenyls) | | 7.4 | 0.08 |
| Fluorenes | | 10.1 | 0.11 |
| Phenanthrenes | 13.1 | | |
| Naphthene-phenanthrenes | | 11.0 | 0.18 |
| Pyrenes, fluoranthenes | 20.5 | | 0 |
| Chrysenes | 10.4 | | 0 |
| Benzofluoranthenes | 6.9 | | 0 |
| Perylenes | 5.2 | | 0 |
| Benzothiophenes | 2.4 | | |
| Dibenzothiophenes | 2.4 | | |
| Naphthobenzothiophenes | | 2.4 | |
| Total | 64.4 | 35.6 | 0.60 |

A typical FCC main column bottoms or clarified slurry oil has the following analysis and properties:

| Elemental Analysis, Wt. % | |
|---|---|
| C | 89.93 |
| H | 7.35 |
| O | 0.99 |
| N | 0.44 |
| S | 1.09 |
| Total | 99.80 |
| Pour Point, °F.: | 50 |
| COR, %: | 9.96 |
| Distillation: | |
| IBP, °F.: | 490 |
| 5%, °F.: | 640 |
| 95%, °F.: | 905 |

Another preferred hydrogen-donor material is a light cycle oil (LOO) taken from the main tower fractionator in a Fluid Catalytic Cracking (FCC) operation of the riser type in which the LOO results from the distillation cut point not substantially above about 700° F.

A typical FCC light cycle oil (LOO) has the following analysis of properties:

| | FCC LOO |
|---|---|
| Boiling Point Distribution, wt. % | |

-continued

| | FCC LOO |
|---|---|
| 420° F. | 4.8 |
| 420–650° F. | 87.9 |
| 650–800° F. | 7.3 |
| 800–1000° F. | — |
| 1000° F. + | — |
| H, wt. % | 10.64 |
| S, wt. % | 1.01 |
| N, wt. % | 0.24 |
| Ni + V, PRM | — |
| COR, wt. % | — |
| Paraffins, wt. % | 12.7 |
| Mononaphthenes | 11.7 |
| Polynaphthenes | 12.8 |
| Monoaromatics | 24.7 |
| Diaromatics | 21.7 |
| Polyaromatics | 14.3 |
| Aromatic sulfur type | 2.1 |
| Total hydrogen, wt. % | 9.0–9.5 |

FCC main tower bottoms and light cycle oils are obtained by the catalytic cracking of gas oil in the presence of a solid porous catalyst. More complete descriptions of the production of these petroleum fractions are disclosed in U.S. Pat. No. 3,725,240 and U.S. Pat. No. 4,302,323.

Catalytically cracked stocks such as clarified slurry oils and light cycle oils are preferred hydrogen-donor materials because of their unique physical properites and chemical constituents. A critical aspect of the hydrogen-donor material is the particular proportions of aromatic naphthenic and paraffinic moieties and the type and content of aromatic and naphthenic structures together with a high content of alpha ($\alpha$) hydrogen provides a superior hydrogen-donor material.

The hydrogen transfer ability of a donor material can be expressed in terms of specific types of hydrogen content as determined by proton nuclear magnetic resonance spectral analysis. Nuclear magnetic resonance characterization of heavy hydrocarbon oils is well developed. The spectra 6 (c/sec) are divided into four bands ($H_\alpha$, $H_\beta$, $H_\gamma$ and $H_{Ar}$) according to the following frequencies in Hertz (Hz snd chemical shift ($\delta$):

| | $H_\alpha$ | $H_\beta$ | $H_\gamma$ | $H_{Ar}$ |
|---|---|---|---|---|
| Hz | 0–60 | 60–100 | 120–200 | 360–560 |
| $\delta$ | 0–1.0 | 1.0–1.8 | 2.0–3.3 | 6.0–9.2 |

The $H_{Ar}$ protons are attached to aromatic rings and are a measure of aromaticity of a material. $H_\alpha$ protons are attached to non-aromatic carbon atoms attached directly to an aromatic ring structure, e.g., alkyl groups and naphthenic ring structures. $H_\beta$ protons are attached to carbon atoms which are in a second position away from an aromatic ring, and $H_\gamma$ protons are attached to carbon atoms which are in a third position or more away from an aromatic ring structure, e.g.,

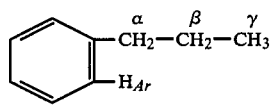

(1)

or

-continued (2)

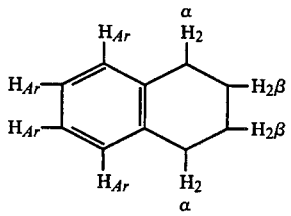

(3)

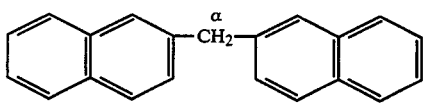

(4)

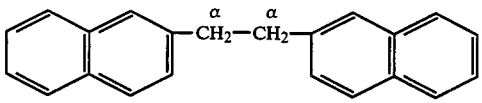

(5)

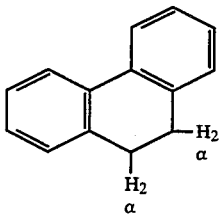

(6)

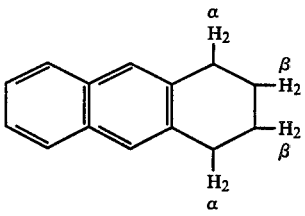

(7)

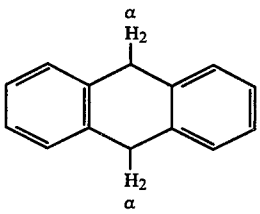

(8)

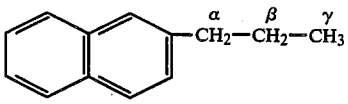

The $H_{AR}$ protons are important because of their strong solvency power. A high content of $H_\alpha$ protons is particularly significant because $H_\alpha$ protons are labile and are potential hydrogen-donors.

It is particularly preferred that the hydrogen-donor material employed in the present invention have a hydrogen content distribution in which the $H_{Ar}$ proton content is between about 20 and 50 percent and the $H_\alpha$ proton content is at least about 20 percent, preferably 20 to 50 percent. For example, in H-donor streams containing 9.5 wt. % total hydrogen, the α-hydrogen content should be at least 1.9 wt. % (20% of total hydrogen content as mentioned above. The balance of the hydrogen is non-α hydrogen.

Hydrogen-donors possessing the desired hydrogen content distribution can be obtained as a bottoms fraction from the catalytic cracking or hydrocracking of gas oil stocks in the moving bed or fluidized bed reactor processes. In general, depending upon such conditions as temperature, pressure catalyst-to-oil ratio, space velocity and catalyst nature, a high severity cracking process results in a petroleum residuum solvent having an increased content of $H_{Ar}$ and $H_\alpha$ protons and a decreased content of the less desirable non-α hydrogens.

The proton distribution in examples of various highly aromatic hydrocarbon by-product streams are shown below.

| Example | $H_\alpha$ | (wt. %) | Non-α Hydrogen | $H_{Ar}$ | Wt. % H Total |
|---|---|---|---|---|---|
| FCC/Light Cycle Oil | | | | | |
| #1 | 22.2 | (2.07) | 57.8 | 20.0 | 9.34 |
| #2 | 34.1 | (3.18) | 36.8 | 29.1 | 9.32 |
| #3 | 34.3 | (3.19) | 35.5 | 30.2 | 9.30 |
| FCC/Clarified Slurry Oil | | | | | |
| #1 | 34.0 | (2.43) | 33.0 | 33.0 | 7.15 |
| #2 | 30.0 | (2.15) | 35.0 | 35.0 | 7.17 |
| #3 | 19.4 | (1.39) | 65.0 | 5.0 | 7.16 |
| FCC/Main Column Bottoms | | | | | |
| #1 | 36.0 | (2.65) | 32.0 | 32.0 | |
| #2 | 36.4 | (2.68) | 18.8 | 44.8 | |
| #3 | 18.5 | (1.36) | 64.3 | 17.2 | |
| #4 | 18.1 | (1.33) | 67.7 | 14.2 | |
| TCC/Syntower Bottoms | | | | | |
| #1 | 29.8 | (2.78) | 28.8 | 41.4 | |
| #2 | 18.2 | (1.70) | 58.8 | 23.0 | |
| #3 | 16.3 | (1.52) | 68.1 | 15.6 | |
| SRC Recycle Oil | 27.1 | | 21.6 | 46.3 | |
| TCC Distillate | | | | | |
| #1 | 21.5 | (2.39) | 58.4 | 20.1 | |
| #2 | 20 | (2.07) | 58 | 22 | |
| #3 | 6.9 | (0.89) | 85.1 | 8 | |

(Note the values in ( ) are absolute pct. amounts and all three LOO streams are effective H-donors.)

All of the values reported above are for un-hydrotreated materials.

From the foregoing it may be seen that hydrocarbons having the same general process derivation may or may not have the desired proton distribution identified in the foregoing discussion. For example, FCC/MOB #1 and #2 and FCC/CSO #1 and #2 have the desired proton distribution while FCC/MOB #3 and #4 and FCC/CSO #3 do not.

Furthermore, although the highly aromatic petroleum residuum donor component of this invention is derived from petroleum, it may be noted in the above table that SCR recycle solvent closely resembles FCC/MOB #1 and #2.

The organic sulfur compound which is introduced into the residua to be subjected to visbreaking preferably is one in which there is present an active thiol (−SH) radical. Suitable compounds include thiophenol, dodecanethiol, and benzothiophene. Dibenzothiophene, on the basis of present knowledge, is not a suitable sulfur compound.

In addition refinery streams obtained from the extraction of paraffinic oils to remove aromatics such as with furfural and other refinery streams can contain sufficient sulfur compounds having sufficient thiol functionality and can be added to the residua, directly or indirectly.

Another method of introducing the organic sulfur compound into the heavy residua is to sulfonate the aromatic extract derived from extracting a paraffinic oil with phenol, furfural and the like to remove aromatic compounds present therein: the sulfonated aromatics are then mildly hydrogenated to form the organic sulfur compound suitable for addition to heavy residua for visbreaking. Technique for aromatic extraction, sulfonation, and hydrogenation to these skilled in the art.

Still another source of thiol compound is the extract obtained by contacting a hydrocarbon stream containing thiophenols with an alkaline solution, such as sodium hydroxide in water or alcohol, decanting the alkaline phase, and then subsequently acidifying the solution to release the thiol compounds. The thiol compounds can be separated and mixed with the heavy residua. This technique provides a means for removing sulfur from one portion of a refinery stream and utilizing the sulfur in another part of the refinery process. Hydrocarbon streams that can be used in the manner include aromatic (furfural) extracts from lube oil stock and cycle oil stock.

The process of the invention is advantageously carried out in refinery facilities in the nature of that shown diagrammmatically in the drawing. A viscous hydrocarbon oil feed, typified by a 925° F.+ Arab Heavy resid, is supplied by line 4 to visbreaking heater 8. The feed is blended with hydrogen donor materials supplied through line 50 in an amount between about 0.1 to b 50 weight percent, preferably from 0.1 to 20 weight percent based on the resid charge, i.e., a weight ratio of hydrogen-donor to resid between about 0.001 to 0.5, and preferably 0.001 to 0.2. Organic sulfur compounds are added through line 2 to provide an amount equivalent to 0.05 to 10 percent by weight of sulfur in the stream flowing in line 2. Preferably the amount added is equivalent to between 0.5 and 5 percent sulfur. Mild thermal cracking of the resid at visbreaking conditions in visbreaker 8 produces a visbreaker effluent stream carried by line 10. This stream is cooled by admixture with a quench stream from line 14, and the visbreaker effluent continues through line 12 to distillation column 22 where it is fractionated to obtain $C_5$- gases ($C_3$, $C_4$ and lower) and a $C_5$ to about 35° C. naphtha fraction from the top through line 24. A 430° F. and heavier fraction is taken off as a bottoms stream through line 6 where portions may be recycled as a quench stream 14, recovered as heavy fuel oil 18 or blended with cutter stock 20 to meet fuel oil product specifications.

The overhead fraction removed from the distillation column in line 24 is passed through a cooler separator 6 which is operated under conditions effective to separate the incoming liquid into a $C_5$- off -gas stream 28, mainly $C_3$ or $C_4$ and lower, and a $C_5$ to 135° naphtha fraction which is taken off via line 30. Because of the quality of the hydrogen-donor, it can be removed in admixture with the heavy oil fraction and used directly as heavy fuel oil, thus avoiding separation.

The process of this invention is suitable for upgrading a wide variety of heavy liquid hydrocarbon oils in which mixtures of at least 75 weight percent of the components boil over 370° C. Included in this class of feeds for the present process are residual fractions obtained by catalytic cracking of gas oils, solvent extracts obtained during the processing of lube oil stocks, asphalt precipitates obtained from deasphalting operations, high boiling bottoms or resids obtained during vacuum distillation of petroleum oils, tar sand bitumen feedstocks, and the like.

Visbreaking process conditions can vary widely based on the nature of the heavy oil material, the hydrogen-donor material and other factors. In general, the process is carried out at temperatures ranging from 350° to 485° C., preferably 425° to 455° C., at residence times ranging from 1 to 60 minutes, preferably 7 to 20 minutes. The pressures employed will be sufficient to maintain liquid phase conditions usually a pressure within the range of from about 200 to 1000 psig.

An important aspect of the invention is the improvement of visbreaker performance by optimizing operation severity for heavy oil feedstocks. In general, as severity is increased yields of distillate and gaseous hydrocarbons are obtained with a reduction in the amount of cutter oil required to blend specification-viscosity residual fuel oil. At high severities, however, there is an increased tendency to form coke deposits which result in plugged heater tubes and/or the production of unstable fuel oils as measured by sediment formation. The use of certain hydrogen-donors as defined above coupled with the addition of organic sulfur compounds has been found to suppress the formation of sedimentation species and thus permit visbreaking at a maximum severity consistent with production of stable fuel oil. As an example, the visbreaking of a heavy petroleum feed stock conventionally carried out at a severity of 500 ERT seconds may be increased to a higher severity of 800 ERT seconds to obtain a fuel oil products free of sedimenting species. At high severities, the cutter stock requirement is substantially reduced which thus represents a considerable financial savings.

EXAMPLE

The effectiveness of thiophenolic compounds in increasing the hydrogen donor capacity of a hydrogen donor solvent was demonstrated by the following tests.

Four tests were made utilizing heavy-wall glass tubes into which the materials shown in column 2 of the following Table were added in the amounts shown in Column 3. The tubes were blanketed in nitrogen, sealed and heated at 440° C. for 1 hour. The mixtures were then analyzed using vapor pressure chromatography and the hydrogen-donor capacity of each mixture was calculated.

TABLE

| 1 Run No. | 2 Compounds | 3 Weight, gms | 4 Wt % Sulfur | 5 H-donor Capacity |
|---|---|---|---|---|
| 1 | Durban Clarified | .2311 | 4.83 | 0.893 |
| | Slurry oil | | | |
| | benzophenone | .2007 | | |
| 2 | Clarified | .2093 | 0.95 | 1.16 |
| | Slurry oil | | | |
| | benzophenone | .2026 | | |
| 3 | Clarified | .2110 | 0.95 | 4.81 |
| | Slurry oil | | | |
| | thiophenol | .0431 | 3.88 | |
| | benzophenone | .2011 | — | |
| 4 | Clarified | .2069 | 0.95 | 0.876 |
| | Slurry oil | | | |
| | dibenzothiophene | .0770 | 3.88 | |
| | benzophenone | .2019 | — | |

I claim:

1. A method for visbreaking a heavy petroleum residual oil comprising:

(a) adding to said residual oil an organic sulfur compound having an active thiol component; and (b) visbreaking said oil in the presence of a highly aromatic hydrogen donor material characterized by its hydrogen content distribution wherein $H_{Ar}$ and $H_{\alpha}$ are each at least about 20 percent of the total hydrogen-donor hydrogen content, and thereafter recovering a fuel oil product having reduced viscosity.

2. The method of claim 1 wherein the $H_{Ar}$ proton content is between 20 and 50 percent and the $H_{\alpha}$ proton content is between about 20 and 50 percent.

3. The method of claim 2 wherein the hydrogen donor solvent has $H_{\alpha}$ content of at least 1.9 wt. % and $H_{Ar}$ content of at least 2.0 wt. %.

4. The method of claim 2 wherein the hydrogen-donor material is an FCC main column bottoms.

5. The method of claim 2 wherein the hydrogen-donor material is a clarified slurry oil.

6. The method of claim 2 wherein the hydrogen-donor material is a TCC syntower bottoms.

7. The method of claim 2 wherein the hydrogen-donor material is a light cycle oil.

8. The method of claim 2 wherein visbreaking is carried out at temperatures ranging from 350° to 485° C., at a hydrogen donor solvent concentration level ranging from 0.1 to 50 wt. % based on the total visbreaking feed, the feed residence time ranging from 1 to 60 minutes.

9. The method of claim 1 wherein said organic compound is selected from the group consisting of thiophenol, dodecanethiol and benzothiophene.

10. A method according to claim 1 which is carried out in the absence of free hydrogen.

11. A method for visbreaking a heavy petroleum residual oil comprising:

(a) adding to said residual oil a hydrocarbon stream derived from the refining of petroleum and containing sulfur compounds having a thiol functionality; and (b) visbreaking said oil in the presence of a highly aromatic hydrogen donor material characterized by its hydrogen content distribution wherein $H_{Ar}$ and $H_{\alpha}$ are each at least about 20 percent of the total hydrogen-donor hydrogen content, and thereafter recovering a fuel oil product having reduced viscosity.

12. The method of claim 11 wherein the $H_{Ar}$ proton content is between 20 and 50 percent and the $H_{\alpha}$ proton content is between about 20 and 50 percent.

13. The method of claim 12 wherein the hydrogen donor solvent has an $H_{\alpha}$ content of at least 1.9 wt. % and $H_{Ar}$ content of at least 2.0 wt. %.

14. The method of claim 12 wherein the hydrogen-donor material is an FCC main column bottoms.

15. The method of claim 12 wherein the hydrogen-donor material is a clarified slurry oil.

16. The method of claim 12 wherein the hydrogen-donor material is a TCC syntower bottoms.

17. The method of claim 12 wherein the hydrogen-donor material is a light cycle oil.

18. The method of claim 12 wherein visbreaking is carried out at temperatures ranging from 350° to 485° C., at a hydrogen solvent concentration level ranging from 0.1 to 50 wt. % preferably ranging from 0.1 to 20 wt. % based on the total visbreaking feed, the feed residence time ranging from 1 to 60 minutes.

19. A method according to claim 11 which is carried out in the absence of free hydrogen.

20. A method for visbreaking a heavy petroleum residual oil comprising:

(a) sulfonating an extract of aromatic compounds derived from the extraction of paraffinic lubricating oil stock by contacting said aromatics with sulfuric acid; and recovering a mixture of sulfonated aromatic organic compounds;

(b) hydrogenating said mixture by contacting it with hydrogen and recovering a mixture of aromatic compounds having a thiol group thereon;

(c) adding to said residual oil the mixture of aromatic organic compounds of (b) having an active thiol component, and (d) visbreaking said oil in the presence of a highly aromatic hydrogen donor material characterized by its hydrogen content distribution wherein $H_{Ar}$ and $H_{\alpha}$ are each at least about 20 percent of the total hydrogen-donor hydrogen content, and thereafter recovering a fuel oil product having reduced viscosity.

21. The method of claim 20 wherein the $H_{Ar}$ proton content is between 20 and 50 percent and the $H_{\alpha}$ proton content is between 20 and 50 percent.

22. The method of claim 21 wherein the hydrogen donor solvent has an $H_{\alpha}$ content of at least 1.9 wt. % and $H_{Ar}$ content of at last 2.0 wt. %.

23. The method of claim 21 wherein the hydrogen-donor material is an FCC main column bottoms.

24. The method of claim 21 wherein the hydrogen donor material is a clarified slurry oil.

25. The method of claim 21 wherein the hydrogen-donor material is a TCC syntower bottoms.

26. The method of claim 21 wherein the hydrogen-donor material is a light cycle oil.

27. The method of claim 21 wherein visbreaking is carried out at temperatures ranging from 350° to 485° C., at a hydrogen donor solvent concentration level ranging from 0.1 to 50 wt. % based on the total visbreaking feed, the feed residence times ranging from 1 to 60 minutes.

28. A method according to claim 20 which is carried out in the absence of free hydrogen.

* * * * *

UNITED STATES PATENT AND TRADEMARK OFFICE

CERTIFICATE OF CORRECTION

PATENT NO. : 4,587,007

DATED : May 6, 1986

INVENTOR(S) : Leslie R. Rudnick

It is certified that error appears in the above-identified patent and that said Letters Patent is hereby corrected as shown below:

Col. 1, lines 65-66, "(350-650°C)" should read --(350-650°F)--

Col. 3, lines 59, 61, 63 and 66, "LOO" should read --LCO--

Col. 4, line 44, "spectra 6" should read --spectra 60--

Col. 6, line 35, "LOO" should read --LCO--

Col. 6, line 50, "SCR" should read --SRC--

Col. 7, line 5, after "hydrogenation" insert --are known--

Col. 7, line 25, after "to" delete "b"

Col. 7, line 40, "35°C" should read --135°C--

Col. 7, line 42, "line 6" should read --line 16--

Col. 7, line 47, "separator 6" should read --separator 26--

Col. 8, line 10, insert a comma (,) after "increased", before "yields" insert --increased--

Col. 10, line 5, Claim 18, before "solvent" insert --donor--

Col. 10, line 6, Claim 18, delete "preferably ranging from 0.1 to 20 wt.%"

Col. 10, line 36, Claim 22, "last" should read --least--

Signed and Sealed this

Twenty-first Day of October, 1986

[SEAL]

*Attest:*

DONALD J. QUIGG

*Attesting Officer*

*Commissioner of Patents and Trademarks*